United States Patent [19]

Bijl et al.

[11] 4,257,161

[45] Mar. 24, 1981

[54] DRY-SHAVING APPARATUS

[75] Inventors: Hendrik A. C. Bijl; Wijtes Bergsma, both of Drachten, Netherlands

[73] Assignee: U.S. Philips Corporation, New York, N.Y.

[21] Appl. No.: 946,561

[22] Filed: Sep. 28, 1978

[30] Foreign Application Priority Data

Nov. 28, 1977 [NL] Netherlands ..... 7713044

[51] Int. Cl.[3] ..... B26B 19/14

[52] U.S. Cl. ..... 30/43.6; 64/9 R

[58] Field of Search ..... 30/43.4–43.6, 30/346.51; 64/9 R; 403/14, 335, 336

[56] References Cited

U.S. PATENT DOCUMENTS

| | | | |
|---|---|---|---|
| 1,643,353 | 9/1927 | Stiefel | 64/9 R |
| 2,823,527 | 2/1958 | Belden | 64/9 R |
| 2,893,222 | 7/1959 | Albedyhl | 64/9 R |
| 3,890,705 | 6/1975 | Tietjens | 30/43.6 |
| 4,036,031 | 7/1977 | Woodling | 64/9 R X |
| 4,038,748 | 8/1977 | Tyler | 30/43.6 |
| 4,087,909 | 5/1978 | Naemura | 30/43.6 |

*Primary Examiner*—Gary L. Smith

*Attorney, Agent, or Firm*—T. A. Briody; W. J. Streeter; R. E. Schneider

[57] ABSTRACT

A dry-shaving apparatus comprising a circular shear plate; a circular cutting member associated with and rotatable relative to the shear plate; mechanism to effect rotation of the cutting member; and a rotatable spindle tiltably coupled at one end to said cutting member and tiltably coupled at the other end to said rotating mechanism, each such tiltable coupling including a three-point contact equi-spaced about the axis of rotation of the rotatable spindle between said rotatable spindle and the cutting member on the one hand and between said rotatable spindle and the rotating mechanism on the other hand.

3 Claims, 6 Drawing Figures

DRY-SHAVING APPARATUS

This invention relates to a dry-shaving apparatus having a floating shaving head comprising a shear plate with hair-entry apertures, a cutting member which is rotatable relative to the shear plate, and a tiltable rotatable coupling spindle which is rotationally coupled at one end to the cutting member and at the other end to a drive mechanism. A floating shaving head is one which is capable of limited tilting movement relative to the body of the apparatus.

Such a shaving apparatus is known from, for example, U.S. Pat. No. 3,890,705. In this known apparatus a coupling pin at the end of the coupling spindle engages with a coupling slot in the cutting member with a large amount of play. This allows the cutting member to move to and fro relative to the coupling spindle in the longitudinal direction of the slot, which may cause wear and annoying noise.

According to the present invention there is provided a dry-shaving apparatus having a floating shaving head comprising a shear plate with hair-entry apertures, a cutting member which is rotatable relative to the shear plate, and a tiltable rotatable coupling spindle which is rotationally coupled at one end to the cutting member and at the other end to a drive mechanism, wherein at at least one end of the coupling spindle the coupling is a three-point coupling.

In one embodiment of the invention the cutting member has three coupling openings which are distributed around the rotational axis of the cutting member, said one end of the coupling spindle being provided with three axially extending coupling members which respectively engage in the coupling openings.

Each coupling member may have on one side a face for engagement with a wall of one of said coupling openings to define one of three places of contact of a three-point coupling at said one end of the coupling spindle, and on the opposite side a face which extends helically of the coupling spindle and which is cooperable with a part of the cutting member to guide the coupling member into one of said openings during assembly of the cutting member and the coupling spindle.

Said other end of the coupling spindle may be provided with a flange which is housed in a cavity in a hub of a gear wheel of the drive mechanism, the flange being movable in the cavity to permit tilting of the coupling spindle relative to the gear wheel, and three ribs may be formed on the wall of the cavity for respective engagement in three recesses in the periphery of the flange to form a three-point coupling at said other end of the coupling spindle, the ribs being distributed about and extending parallel to the rotational axis of the gear wheel, and the recesses being correspondingly distributed about the rotational axis of the coupling spindle.

Figure 1:
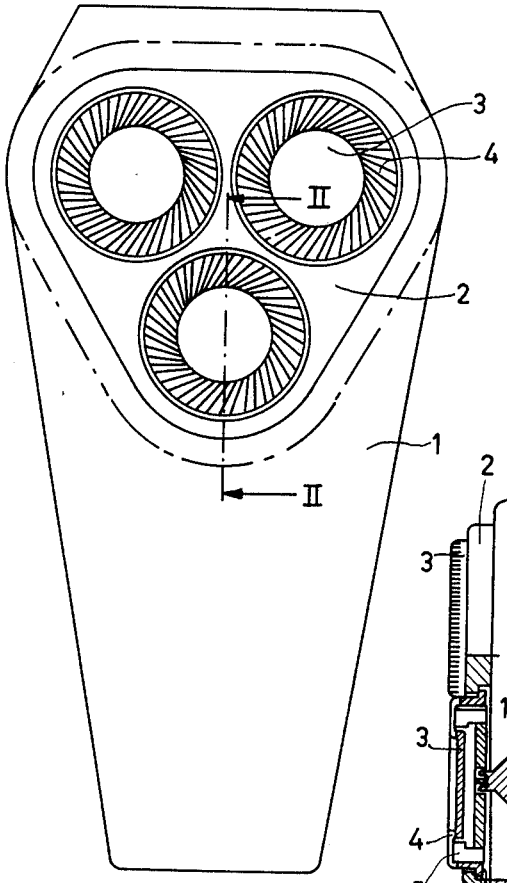
Figure 2:
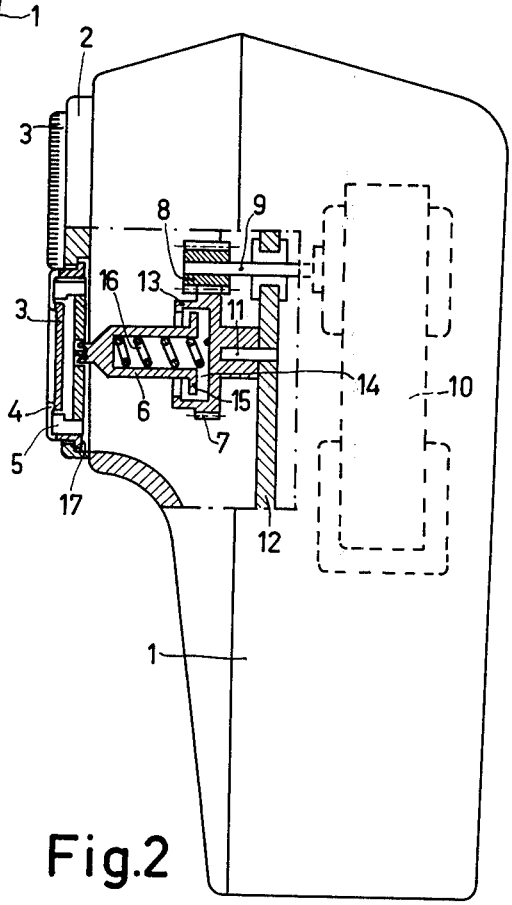
Figure 3:
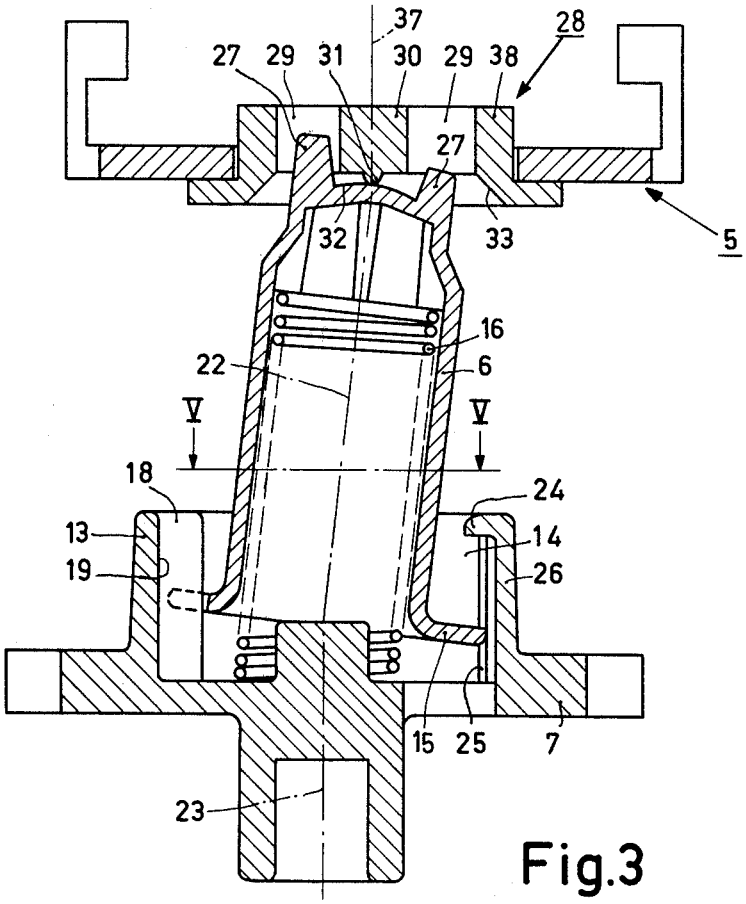
Figure 4:
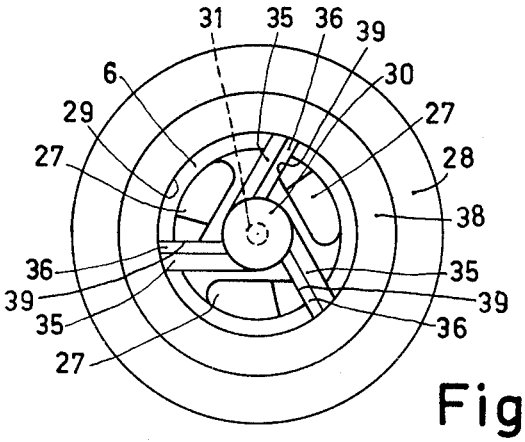
Figure 5:
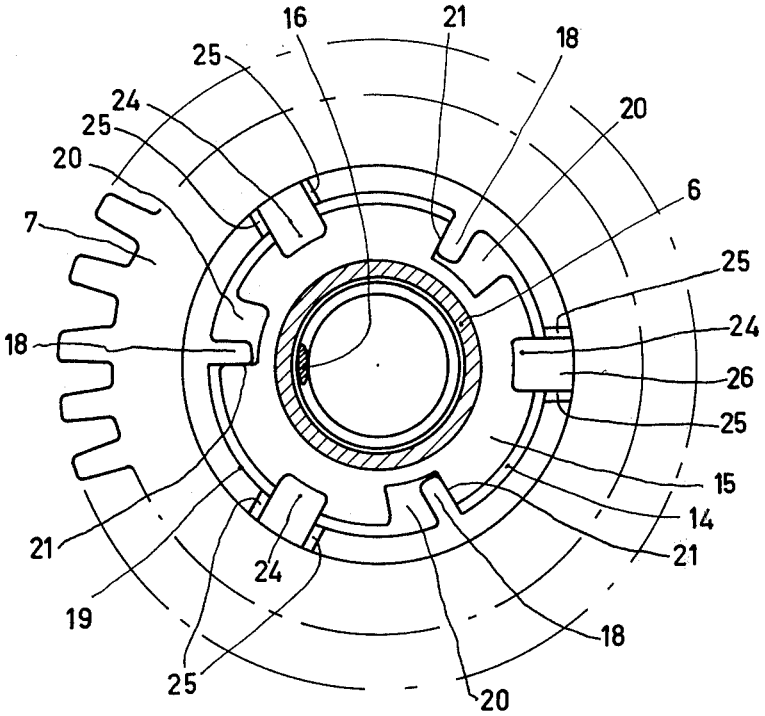
Figure 6:
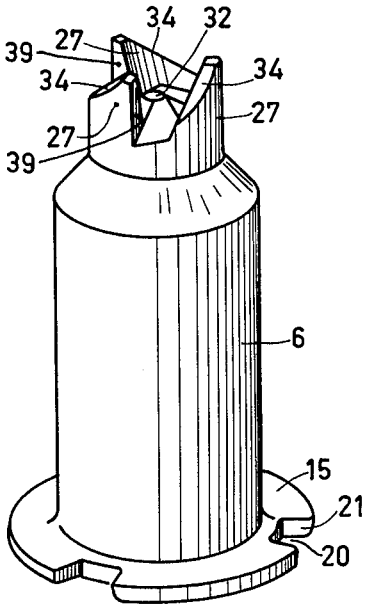

The invention will now be described with reference to the accompanying drawings, in which FIG. 1 is a front elevation of a dry-shaving apparatus according to an embodiment of the invention having three floating heads, FIG. 2 is a side elevation of the shaving apparatus of FIG. 1 with one of the shaving heads shown in cross-section taken on the line II—II in FIG. 1, FIG. 3 is an enlarged axial sectional view of the rotary cutting member, the coupling spindle of one of the shaving heads and an associated gear wheel of the drive mechanism, FIG. 4 is a plan view of the coupling spindle shown in FIG. 3 and a part of the cutting member, FIG. 5 shows a cross-section taken on the line V—V in FIG. 3, and FIG. 6 shows the coupling spindle in perspective.

The shaving apparatus shown in FIGS. 1 and 2 comprises a housing 1 on which is mounted a shear-plate holder 2 for three stationary shear plates 3. The shear plates 3 have hair entry apertures 4. A rotary cutting member 5 is situated on the inner side of each shear plate 3, for cooperation therewith in known manner.

The cutting members are rotated relative to the respective shear plates by a drive mechanism comprising an electric motor 10, to which the cutting members are each coupled by an associated coupling spindle 6 and gear wheel 7 and a gear wheel 8 fixed on the motor shaft 9. The gear wheels 7 are each rotatably journalled on an associated spindle 11 which is secured in a mounting plate 12. Each gear wheel 7 is provided with a hollow hub 13, the interior of which forms a cavity 14 which accommodates a flange 15 on one end of the associated coupling spindle 6. A coil spring 16, which for the its greater part is disposed in an axial bore in the coupling spindle 6 and which is compressed between the coupling spindle and the gear wheel 7, exerts a force on the coupling spindle in the direction of the associated cutting member 5. This force is transmitted to the cutting member 5 by the coupling spindle 6 and via the cutting member to the associated shear plate 3, the flanges edge 17 of which is thereby pressed against the shear plate holder 2. During use of the shaving apparatus, the shear plates 3, together with the associated cutting members 5 and coupling spindles 6, can be pressed inwards against the action of the springs 16 under the pressure of which the shear plates are held against the user's skin.

All three cutting members 5, are coupled to the drive motor 10 in the above manner, the three gear wheels 7 nesting with the single centrally disposed gear wheel on the motor shaft 9.

As is shown in FIGS. 3 and 5, three ribs 18 are formed on the wall 19 of the cavity 14 in the hub 13 of each gear wheel 7. The ribs 18 extend axially of the cavity 14 and project radially inwards from the wall 19 thereof and are equispaced about the axis of rotation 23 of the gear wheel 7. The flange 15 of the associated coupling spindle 6 is formed at its periphery with three equispaced recesses 20, a side wall 21 of each of which engages with a corresponding one of the ribs 18. Thus, a three-point coupling is obtained between the coupling spindle 6 and the gear wheel 7 to transmit the rotary movement of the gear wheel to the coupling spindle. This coupling allows the coupling spindle to be tilted relative to the gear wheel 7, i.e., to assume a position, such as that shown in FIG. 3, in which the axis of rotation 22 of the coupling spindle 6 is neither parallel to nor coincident with the axis of rotation 23 of the gear wheel 7.

On the lip of the hub 13 of each gear wheel 7 are three inwardly directed projections 24 by which the flange 15 of the associated coupling spindle 6 is retained in the cavity 14 in the hub 13. On opposite sides of each projection 24 the hub is formed with axially extending slits 25 so that a wall portion 26 of the hub which is situated between the slits and, which is integral with the projection 24 can move elastically in a radial direction. This enables the end of the coupling spindle 6 on which the flange 15 is formed to be inserted in or removed from the space cavity 14 in a simple manner.

In every tilted position of the coupling spindle 6 relative to the gear wheel 7 the wall 21 of each of the three recesses 20 in the flange 15 of the coupling spindle will be in engagement with the associated rib 18. In theory point contact, line contact or surface contact is possible at the three places of engagement. Also, in the theoretical cases of point contact or line contact, there will locally be surface contact over a small area owing to wear and material deformations which occur in practice. Consequently, the term "three-point coupling " is to be understood to mean coupling by point contact, line contact or surface contact at three places which are spaced about the axes of rotation of the parts to be coupled so that these parts are kinematically defined relative to each other. If initially contact should occur at only one or two of the three places, the parts to be coupled will generally adjust themselves in such a way relative to each other under the influence of the torque to be transmitted between the two parts that a uniquely defined position with three places of contact is obtained. Preferably, the coupling will be so arranged that in this uniquely defined position the parts to be coupled are optimally centred relative to each other with coinciding axes of rotation. In this way a self-centring coupling can be obtained.

On the end of each coupling spindle 6 remote from the flange 15 are formed three axially extending coupling members 27 which are equispaced about the axis of rotation 22 of the spindle. The coupling members 27 engage with three corresponding coupling openings 29 of a coupling piece 28 which forms a hub portion of the cutting member 5. As shown in FIG. 4, from which the rest of the cutting member has been omitted, the coupling piece 28 comprises an annular outer portion 38 and a cylindrical central portion 30 which is connected to the outer portion by three spokes 35 which define the boundaries of the openings 29. The central portion 30 of the coupling piece 28 is provided with a hemispherical pivot surface 31 against which an end face 32, of the coupling spindle 6 bears, which end face is disposed between the coupling members 27.

The coupling spindle 6 is thus also coupled to the cutting member 5 by a three-point coupling which will permit tilting movement of the coupling spindle and the cutting member relative to each other. This coupling has the same properties as those described above for the coupling between the coupling spindle 6 and the gear wheel 7 and may again be self-centring, i.e., the axis of rotation 22 of the coupling spindle 6 passes through the pivot surface 31 and preferably coincides with the axis of rotation 37 of the coupling piece 28. With the known coupling construction referred to earlier herein comprising a coupling slot in the cutting member and a corresponding coupling pin at the end of the coupling spindle, the mating of the two parts of the coupling can present difficulties since it often happens that the coupling pin is not in the correct position relative to the coupling slot when the cutting member is initially placed on the coupling spindle in the assembly of the two parts.

A further disadvantage of this known coupling is that, owing to the large amount of play of the coupling pin in the coupling slot, the pin can generally move to and fro in the slot, which gives rise to wear and undesired noise.

In the case of the above-described three-point coupling between the coupling spindle 6 and the cutting member 5, the coupling spindle is always in a position in which the coupling members 27 are disposed directly opposite the openings 29 of the coupling piece 28 after a rotational movement of the coupling spindle 6 through 120° about the axis of rotation 22, which facilitates coupling of the parts 27 and 28. Coupling is further simplified by the provision of a conical surface 33 on the coupling piece 28, by which surface the coupling members 27 are guided towards the openings 29 during coupling.

Under similar conditions, the surface pressure at each place of contact in a three-point coupling, with its three places of contact, is smaller than in the case of a coupling with two places of contact, so that the wear at the places of contact will be reduced. Moreover, in comparison with known constructions the coupling members 27 can be spaced at a comparatively large radial distance from the axis of rotation 22 of the coupling spindle 6. The forces which are exerted on the coupling piece 28 by the coupling members 27 consequently have a comparatively large moment arm so that these forces can be smaller and will give rise to less wear.

As can be seen in FIG. 6, the coupling members 27 each have an axially extending face 39 on one side for driving engagement with one of the three spokes 35 of the coupling piece 28. On the opposite side each coupling member 27 has a helically extending guide face 34 which, if the coupling members 27 are not located directly opposite the openings 29 when the cutting member 5 is initially placed on the coupling spindle 6 in the assembly of these two parts, slides over one of the spokes 35 under the action of the spring 16 on the coupling spindle so that the entry of the coupling members 27 into the openings 29 is controlled and does not take place abruptly and with an impact.

The spokes 35 have faces 36 for engagement by the axially extending faces 39 of the coupling members 27 to establish the three-point coupling between the coupling spindle 6 and the cutting member 5. The faces 36 may each be slightly inclined relative to a plane containing the axis of rotation 37 of the cutting member 5, and extending parallel to the respective spokes 35, so that the places of contact between the coupling members 27 and the coupling piece 28 can be influenced.

What is claimed is:

1. A dry-shaving apparatus comprising a circular shear plate provided with hair-entry apertures; a circular cutting member associated with and rotatable relative to the shear plate; means to effect rotation of the cutting member; and a rotatable spindle tiltably coupled at one end to said cutting member and tiltably coupled at the other end to said rotating means, the cutting member having three coupling openings equi-spaced about its rotational axis, said one end of the rotatable spindle being provided with three axially extending coupling members equi-spaced about its axis of rotation for respective engagement with said coupling openings, and each coupling member having on one side a surface for engagement with a wall of the associated coupling opening and on the opposite side means cooperable with the cutting member to guide the coupling member into its respective coupling opening during assembly of the cutting member and the rotatable spindle.

2. A dry-shaving apparatus according to claim 1, in which the means on the opposite side of each coupling member comprises a helical surface cooperable with the cutting member.

3. A dry-shaving apparatus according to claim 1 or 2, in which the rotating means includes a gear wheel having a cavity, the other end of the rotatable spindle is provided with a flange housed in and movable in the gear-wheel cavity to permit tilting of the rotatable spindle relative to the gear wheel, three ribs on the wall of the gear-wheel cavity equi-spaced about and parallel to the rotational axis of the latter, and three recesses in the periphery of the flange of the rotatable spindle equi-spaced about and parallel to its axis of rotation for respective engagement by said ribs.

* * * * *